United States Patent [19]

Brobeck

[11] 4,167,368

[45] Sep. 11, 1979

[54] ADVANCE DIFFUSER APPARATUS FOR A BLOWER HAVING A LARGE IMPELLER DIAMETER

[75] Inventor: Helmut Brobeck, Hessheim, Fed. Rep. of Germany

[73] Assignee: Aktiengesellschaft Kühnle, Kopp & Kausch, Frankenthal, Fed. Rep. of Germany

[21] Appl. No.: 817,239

[22] Filed: Jul. 20, 1977

[30] Foreign Application Priority Data

Jul. 26, 1976 [DE] Fed. Rep. of Germany ..... 2633480

[51] Int. Cl.[2] ..... F04D 29/56

[52] U.S. Cl. ..... 415/162; 415/163

[58] Field of Search ..... 415/151, 155, 159, 160, 415/163, 162

[56] References Cited

U.S. PATENT DOCUMENTS

| | | | |
|---|---|---|---|
| 2,393,042 | 1/1946 | Hagen | 415/160 UX |
| 2,621,848 | 12/1952 | Bentley | 415/160 |
| 2,947,466 | 8/1960 | Busquet | 415/160 X |
| 3,583,827 | 6/1971 | Wood | 415/159 |

FOREIGN PATENT DOCUMENTS

| | | | |
|---|---|---|---|
| 549457 | 11/1942 | United Kingdom | 415/163 |

*Primary Examiner*—Carlton R. Croyle
*Assistant Examiner*—Donald S. Holland
*Attorney, Agent, or Firm*—Herbert L. Lerner

[57] ABSTRACT

Advance diffuser for an axial blower having an impeller of large diameter received in a substantially circular housing and an axis extending in a given direction, includes a suction box formed with an intake opening through which a medium is drawable by suction in a direction substantially perpendicular to the given direction of the blower axis, a plurality of swirl vanes mounted on respective, mutually parallel shafts in the suction box, the suction box having a pair of mutually opposing parallel walls wherein the shafts are rotatably mounted, a pair of casing surface sections mutually connecting the parallel walls and tangentially merging with and surrounding the substantially circular outline of the impeller housing, the suction box having another wall facing toward the impeller and formed with a suction opening, the parallel shafts whereon the swirl vanes are respectively mounted being disposed along an arc surrounding part of the suction opening, the arc having end points mutually connectible by a secant to the circular outline of the impeller housing.

5 Claims, 2 Drawing Figures

ADVANCE DIFFUSER APPARATUS FOR A BLOWER HAVING A LARGE IMPELLER DIAMETER

Figure 1:
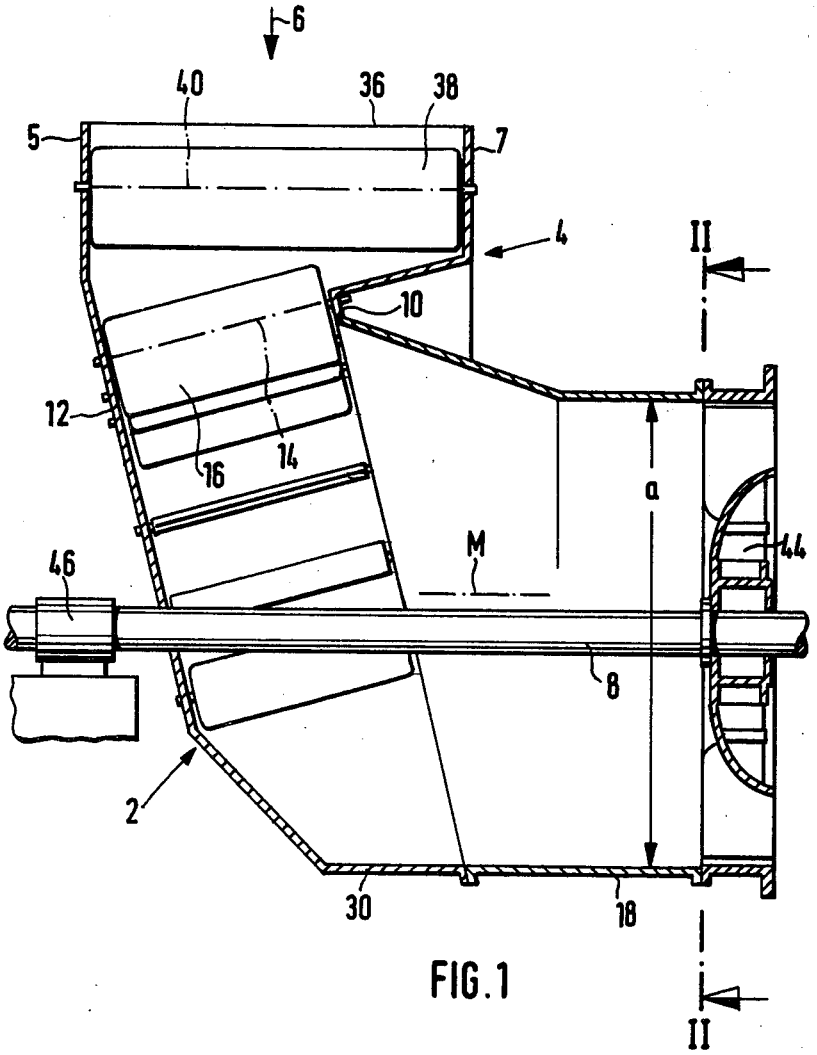

The invention relates to an advance diffuser with adjustable guide vanes for an axial blower. Such advance diffusers are used primarily in axial blowers with rotor blades that are not adjustable during operation, for example, in axial cnstant-pressure blowers, so that the volume flow and the pressure increase are able to be adapted or accommodated to prevailing operating conditions.

Adjustable axial-flow advance diffusers (so-called twist or swirl controls) have become known heretofore wherein the rotary axes of the guide vanes are disposed forward of the impeller perpendicularly to the rotary axis of the blower over the entire periphery of the inlet channel (German Pat. No. DT-PS 17 03 029). Radial diffusers with adjustable guide vanes disposed forward of radial blowers are additionally known wherein the rotary axes of the guide vanes are parallel to the blower axis, the direction of flow being perpendicular to the blower axis (German Published Non-Prosecuted Application DT-OS 24 03 113). It has, furthermore, also been known heretofore to dispose so-called twist or swirl vanes with rotary axes parallel to the blower axis only in the suction box of radial blowers i.e. not annularly or ring-shaped about the blower axis (German Published Prosecuted Application DT-AS 18 16 014).

With the increasing size of contemporary axial blowers, the advance axial diffusers associated therewith attain diameters of up to 6.3 meters. Blowers of that size are manufactured for reasons of cost in a lightweight construction out of relatively thin sheetmetal welded together. The mechanism for adjusting the guide vanes then also becomes relatively elastic, as it cannot be more stable than the housing per se (note German Pat. No. DT-PS 8 45 156, FIG. 6 and German Published Non-Prosecuted Application DT-OS 24 26 824). In addition to the foregoing, are added in many cases deformations due to high operating temperatures. On the other hand, the adjustment of the guide vanes must be effected with minimum play, little elastic deformation and little friction.

Under the constraints of lightweight construction, it is hardly possible any more to construct a satisfactory adjusting mechanism for very large axial-inlet diffusers. Larger and larger adjusting torques must be introduced to overcome friction and jamming.

The attained diameters of the advance axial diffusers require the provision of additional support for the guide vanes in the heart of the axial blower in order to control the stressing of the guide-vane shafts. Provision of this additional interior support or bearings for the guide vanes results in a further increase in the friction and jamming forces.

Heretofore known radial vane diffusers are suited for avoiding the mechanical difficulties of large axial diffusers, because the individual vanes of the radial diffusers are relatively short and are mountable at two points thereof without difficulty. The vane shafts thereof are mounted in planar, parallel walls and not in a cylindrical casing as with axial diffusers. The possible solutions for simple adjusting mechanisms which are as free as possible for jamming and from friction, are more readily attainable with advance radial diffusers having vane shafts disposed in one plane. However, it is prohibitive to use heretofore known radial diffusers because of the very large dimentions and weights thereof that are required for large axial blowers.

The use of swirl vanes, conventional for radial blowers, in the suction box results, for large axial blowers, in no adequate control range attainable with good flow efficiency.

The invention relates especially to an advance diffuser for an axial blower having a large impeller diameter, and including a suction box, the direction of suction through which is approximately perpendicular to the axis of the blower, the mutually parallel rotary axes of the swirl vanes of the advance diffuser being mounted in mutually parallel walls of the suction box, casing surface suctions connecting the parallel walls of the suction box merging so as to enclose and tangentially engage the circular outline of the impeller housing, and the walls of the suction box on the impeller side having a suction opening.

In a suction elbow of this general type, heretofore known from German Published Non-Prosecuted Application DT-OS 1 816 014, a row of swirl vanes is disposed as a diffuser immediately behind the opening of the suction box, the rotary axes of the swirl vanes being disposed in a plane which is parallel to the suction opening of the suction box. This construction is much less costly than the flow dynamically fully satisfactory construction of the German Published Non-Prosecuted Application DT-OS 2 403 113, wherein the diffuser surrounds the blower axis coaxially concentrically. This flow dynamically more advantageous construction results in extraordinarily large dimensions and is therefore considerably more costly than the construction according to the German Published Non-Prosecuted Application DT-OS 1, 816 014; for a diameter of the centrifugal blower of 5 m, for example, the diameter of the radial vane control is about six to seven meters.

It is an object of the invention to provide a suction elbow with an advance diffuser for a blower having a large impeller diameter wherein the flow dynamics properties of the suction elbow with the advance diffuser of the aforementioned type attain approximately the flow dynamics properties of the construction of German Published Non-Prosecuted Application DT-OS 2 403 113 without increasing the required constructional expense to the same extent. With the foregoing and other objects in view, there is provided in accordance with the invention, in a suction elbow of the foregoing type, a disposition of the axes of rotation or pivot axes of the swirl vanes along an arc which partially surrounds the circular suction opening. In accordance with other features of the invention, the arc extends over at least 180° and preferably over slightly more than 180°. In an especially advantageous construction, in accordance with another feature of the invention, the arc is a circular arc which merges tangentially into the circular outline of the impeller housing.

Due to the disposition of the rotary axes of the swirl vanes along an arc, in accordance with the invention, so that the diffuser only partly surrounds the blower axis, the flow dynamics properties of the diffuser become comparable to those which are attained by the construction, according to German Published Non-Prosecuted Application DT-OS 2 403 113, which requires disproportionally large constructional expense.

In the construction of German Published Non-Prosecuted Application DT-OS 1 816 014, as well as DT-OS 1 403 113, the rotary axes of the swirl vanes are disposed exactly parallel to the blower axis; in the construction according to the invention of the instant application, this is unnecessary. If the mutually parallel rotary axes of the swirl vanes enclose an angle with the blower axis, then the centers of the individual rotary axes of the swirl vanes lie on the aforementioned arc.

An especially compact construction which is manufacturable relatively inexpensively, is attained if the circular arc on which the rotary axes are located, merges tangentially with the circular outline of the impeller housing. If the mutually parallel rotary axes of the swirl vanes enclose an angle with the blower axis, the circular arc merging tangentially with the circular outline of the impeller housing is to be understood in this case to be that arc which is associated with those points of the rotary axes of the swirl vanes which are farthest away from the blower axis.

The flow dynamic effectiveness or efficiency of the diffuser according to the invention is improved still further, in accordance with an additional feature, by disposing, between the diffuser or swirl vanes and the intake opening of the suction box, a row of guide vanes, the axes of rotation of which lie in a plane parallel to the intake opening of the suction box. The guide vanes and the swirl vanes are advantageously adjustable in common, by a mechanism in accordance with another feature of the invention. Furthermore, in accordance with the invention, the guide vanes are adjustable to a shut-off position wherein the guide vanes overlap one another i.e. assume additionally the function also of otherwise conventional shut-off vanes.

Other features which are considered as characteristic for the invention are set forth in the appended claims.

Although the invention is illustrated and described herein as advance diffuser apparatus for a blower having a large impeller diameter, it is nevertheless not intended to be limited to the details shown, since various modifications may be made therein without departing from the spirit of the invention and within the scope and range of equivalents of the claims.

Figure 2:
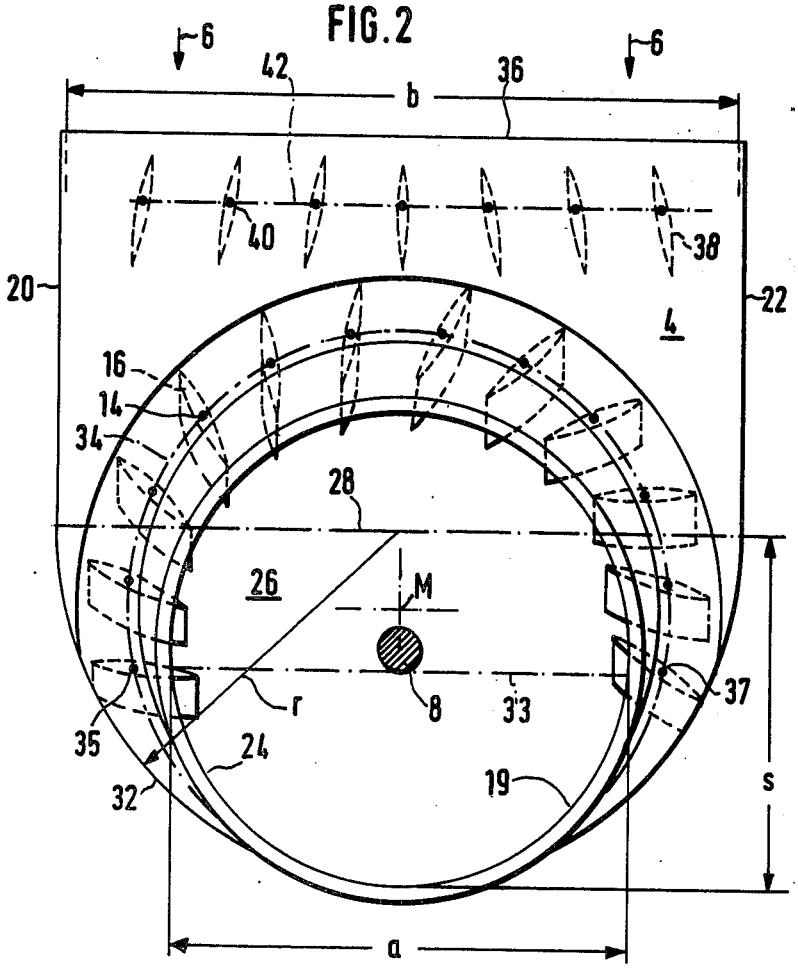

The invention, however, together with additional objects and advantages thereof, will be best understood from the following description when read in connection with the accompanying drawings in which:

FIG. 1 is a diagrammatic longitudinal sectional view of a suction or intake elbow embodying the advance diffuser for an impeller of large diameter constructed in accordance with the invention; and FIG. 2 is a cross-sectional view of FIG. 1 taken along the line II—II in the direction of the arrows.

Referring now to the figures of the drawing, there is shown an advance diffuser for a blower having a large impeller diameter embodied in a suction or intake elbow into which flow medium e.g. air is drawn in by the impeller 44 through a suction box 4 in a suction direction represented by arrows 6. A blower shaft 8 projects out of the suction elbow 2 toward the left-hand side of FIG. 1, and is supported outside the suction elbow in a bearing 46.

Directly behind a suction or intake opening 36 of the suction box 4, the sucked or drawn-in medium encounters a row of guide vanes 38 which are mounted on rotary shafts 40 that are journalled in mutually parallel walls 5 and 7. The rotary shafts 40 are disposed in a plane perpendicular to the plane of the drawing in FIG. 2 and represented by the dot-dash line 42 which is parallel to the suction opening 36 of the suction box 4. The relative dimension of the suction opening 36 in axial plane of the suction box 4 is apparent from FIG. 1, while the width b thereof is visible in FIG. 2.

Parallel walls 10 and 12, between which swirl vanes 16 are mounted on rotary shafts 14 along a circular arc 34, are connected to the parallel walls 5 and 7, between which the guide vanes 38 are mounted, as shown in FIG. 2. The dimension of the diffuser formed by the swirl vanes 16, in the direction of i.e. along, the circular arc 34, is considerably larger than the width b of the suction or intake opening 36, over the extent of which the row of guide vanes 38 is disposed. Consequently, in the region of the circular arc 34 i.e. of the swirl vanes 16, the spacing between the parallel walls 10 and 12 (in FIG. 1) is made smaller than the distance between those parallel walls 5 and 7 between which the guide vanes 38 are mounted so that the flow cross section in the region of the swirl vanes 16 is then approximately equal to the flow cross section in the region of the guide vanes 38 when the swirl vanes 16 and the guide vanes 38 are fully open.

As can be seen from FIG. 2, the width b of the suction box 4 is greater than the diameter a of a housing 19 for the impeller 44 (see also FIG. 1). Housing walls 20 and 22 mutually connecting the parallel walls 10 and 12 of the suction box 4, extend parallel to one another initially up to a transverse plane represented by the dot-dash line 28 in FIG. 2. This transverse plane 28 is spaced a substantially radial distance s from that location 18 of the impeller housing wall 19 which extends from the suction box 4. This distance s is approximately equal to one-half the width b of the suction box 4 or somewhat smaller. Adjoining the parallel walls 20 and 22 is a housing surface section 32 having a semicircular appearance in the cross-sectional view of FIG. 2, the radius r of which is equal to one-half the width b of the suction box 4 and thus approximately equal to the distance s (or somewhat larger). Due to this shape of the housing surface section 32, there is adequate space on the right-hand and left-hand sides to dispose and distribute the swirl vanes 16 around the blower axis 8 about a circular arc of more than 180°. This is made possible especially due to the fact that the center M of the circular arc 34 on which the rotary shaft 14 of the swirl vanes 16 are located, is disposed eccentrically to the blower shaft 8 in such a manner as to be situated between the blower shaft 8 and the transverse plane 28.

It is also evident from FIG. 2 that the circular arc 34, on which the rotary shafts 14 of the swirl vanes 16 are located, runs substantially tangentially into the circular outline 24 of the impeller housing 19 at the location 18 thereof. This results in an especially compact and, therefore, inexpensive construction of the illustrated embodiment.

The guide vanes 38 are advantageously adjustable so that they overlap one another and can completely close off the suction or intake opening 36 of the suction box 4. A separate shut-off or blocking device is not necessary then but is, rather, provided by the guide vanes 38 per se.

Those swirl vanes 16 which are closest to that part of the wall 19 which faces away from the suction box 4, mark the ends 35 and 37 of the arc 34. The straight dot-dash line or secant 33 to the circular outline 24 connecting the points 35 and 37 advantageously extends across the circular suction opening 26 in a manner that the dot-dash line 33 is located between the blower shaft 8 and the wall location 18 of the impeller housing 19 facing away from the suction box 4.

There is claimed:

1. An advance diffuser for an axial blower having an impeller received in a substantially circular housing and an axis extending in a given direction, comprising a suction box formed with an intake opening through which a medium is drawable by suction in a direction substantially perpendicular to the given direction of the blower axis, a plurality of swirl vanes mounted on shafts in said suction box, said suction box having a pair of mutually opposing parallel walls wherein said shafts are rotatably mounted, a pair of housing walls mutually connecting said parallel walls and tangentially merging with and surrounding the substantially circular outline of the impeller housing, said suction box having another wall facing toward the impeller and formed with a circular suction opening, said shafts whereon said swirl vanes are respectively mounted being contained by a circular arc surrounding part of said suction opening, said arc having end points mutually connectible by a secant extending through said circular suction opening.

2. An advance diffuser according to claim 1 wherein said arc surrounding part of said suction opening is an arc of at least 180°.

3. An advance diffuser according to claim 2 wherein said secant is disposed between the blower axis and a wall portion of the impeller housing extending from said suction box.

4. An advance diffuser according to claim 1, including a plurality of rotatable guide vanes having rotary axes disposed in a plane disposed between said swirl vanes, on the one hand, and said intake opening formed in said suction box, on the other hand, and extending parallel to the plane in which said intake opening of said suction box is disposed.

5. An advance diffuser according to claim 4 wherein said guide vanes are adjustable to a shut-off position wherein said guide vanes overlap one another.

* * * * *